US005404829A

United States Patent [19]

Shuert

[11] Patent Number: 5,404,829

[45] Date of Patent: Apr. 11, 1995

[54] RACKABLE PLASTIC PALLET

[76] Inventor: Lyle H. Shuert, 1034 Stratford Pl., Bloomfield Hills, Mich. 48013

[21] Appl. No.: 703,629

[22] Filed: May 21, 1991

Related U.S. Application Data

[63] Continuation-in-part of Ser. No. 524,299, May 15, 1990, abandoned, which is a continuation-in-part of Ser. No. 484,369, Feb. 26, 1990, abandoned.

[51] Int. Cl.[6] ..... B65D 19/00

[52] U.S. Cl. ..... 108/51.1; 108/901

[58] Field of Search ..... 108/51.1, 57.1, 52.1, 108/53.1, 901

[56] References Cited

U.S. PATENT DOCUMENTS

| | | | |
|---|---|---|---|
| 3,404,642 | 10/1968 | Belcher | 108/901 |
| 3,680,496 | 8/1972 | Westlake | 108/901 |
| 3,717,922 | 2/1973 | Witkowski | 108/51.1 |
| 4,397,247 | 8/1983 | Lemelson | 108/901 |
| 4,735,154 | 4/1988 | Hemery | 108/56.1 |
| 4,879,956 | 11/1989 | Shuert | 108/52.1 |
| 5,090,336 | 2/1992 | Longaker | 108/57.1 |

*Primary Examiner*—Kenneth J. Dorner
*Assistant Examiner*—Gerald A. Anderson
*Attorney, Agent, or Firm*—Young, MacFarlane & Wood

[57] ABSTRACT

A plastic pallet including an upper plastic platform structure defining a load receiving surface and a lower plastic base structure defining the pallet support surface. The platform structure and the base structure are interconnected by leg or strut structures which coact with the platform structure and the base structure to define tunnels for the entry of material handling equipment. A series of upper beams are provided in the platform structure, a corresponding series of lower beams are provided in the base structure, and the struts interconnecting the platform structure and base structure serve to interconnect a respective upper beam with a respective lower beam so as to form of series of trusses within the pallet and optimize the rigidity of the pallet. The leg structures interconnecting the platform structure and the base structure are formed as clusters of small leg portions so as to minimize the size of the openings of the legs in the load receiving surface and in the pallet support surface and thereby preserve the planar integrity of these surfaces.

33 Claims, 5 Drawing Sheets

FIG-1
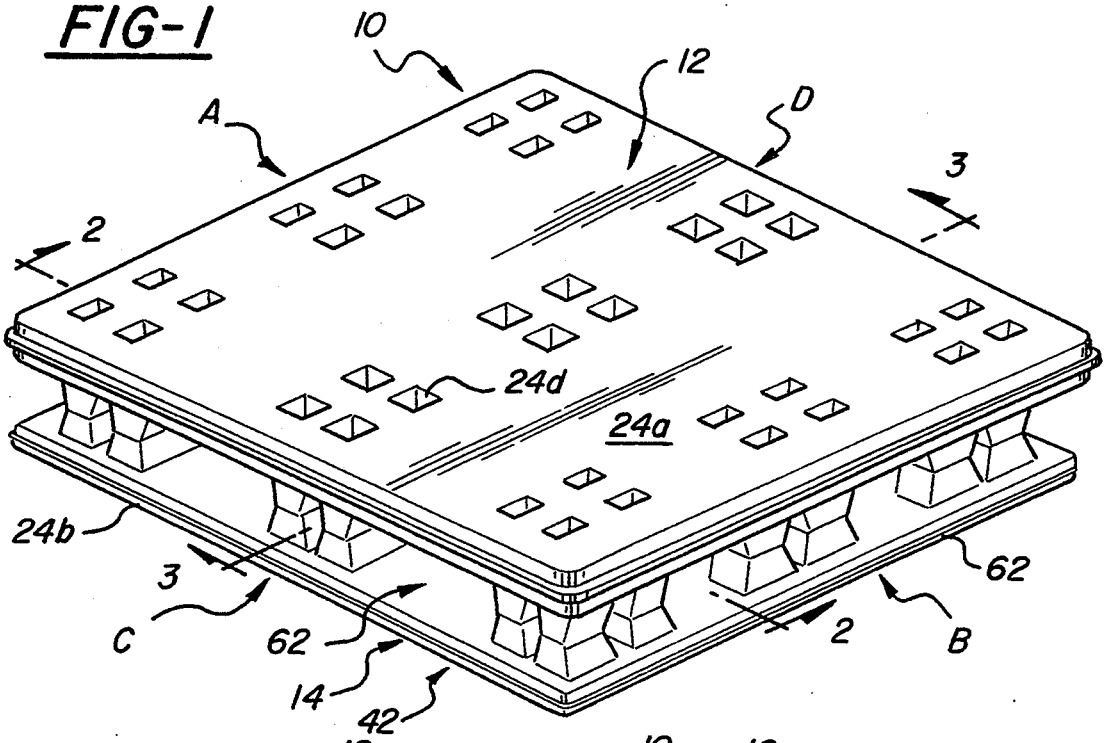
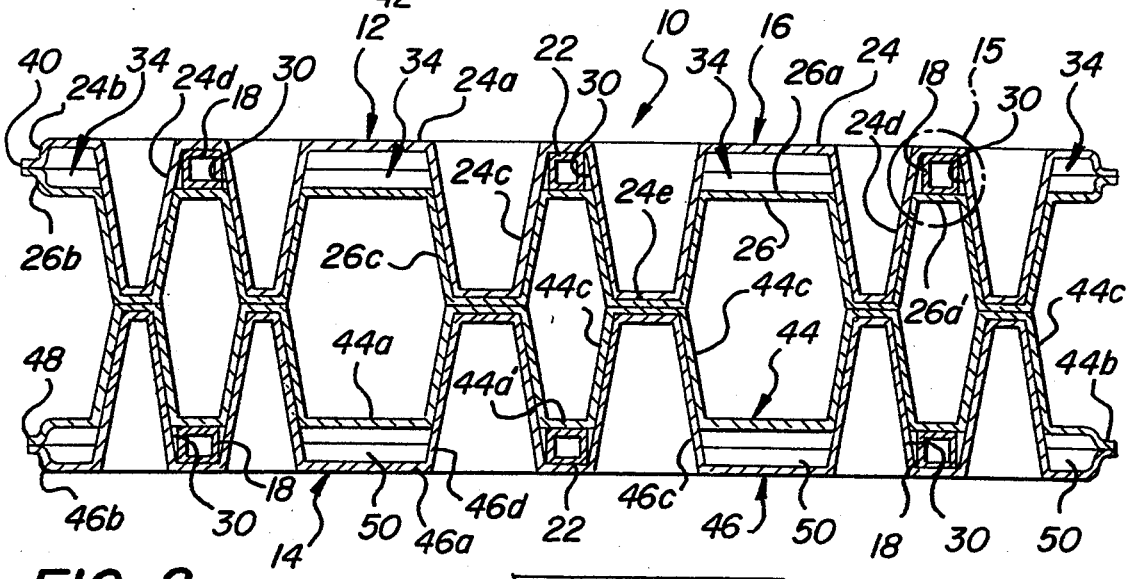
FIG-2
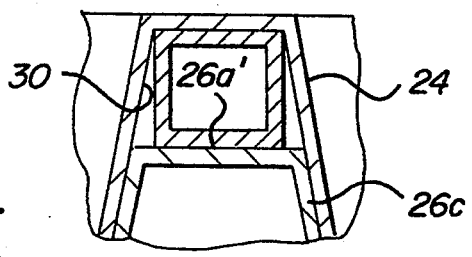
FIG-15

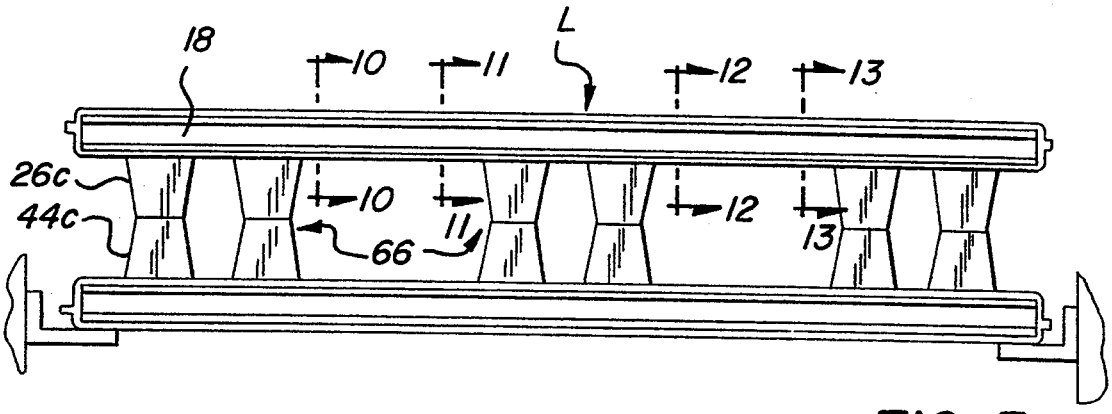
FIG-3
FIG-4
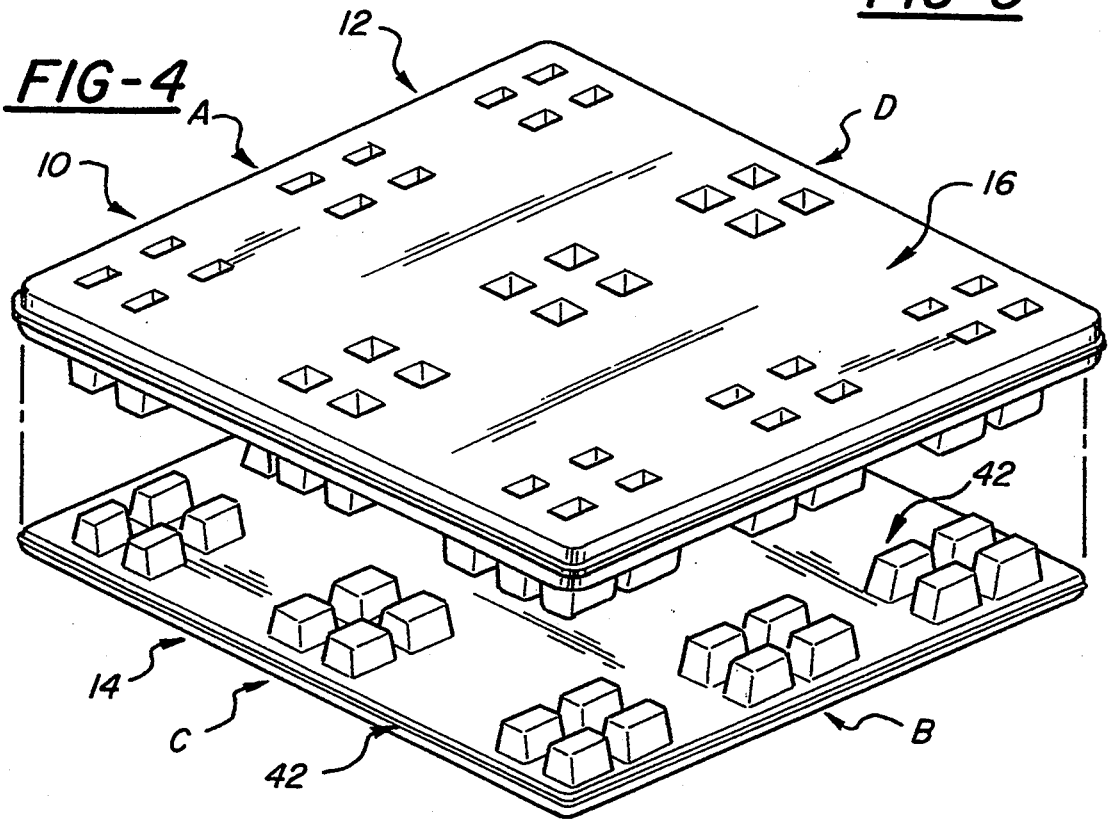
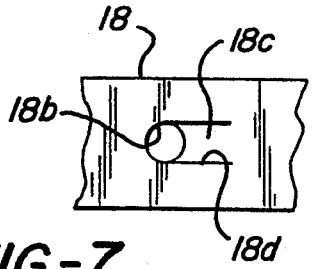
FIG-7
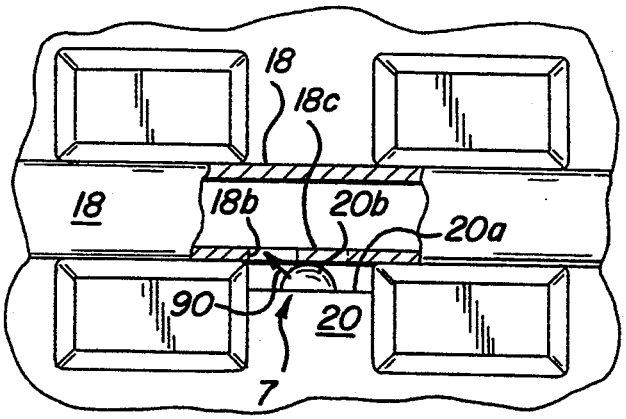
FIG-6

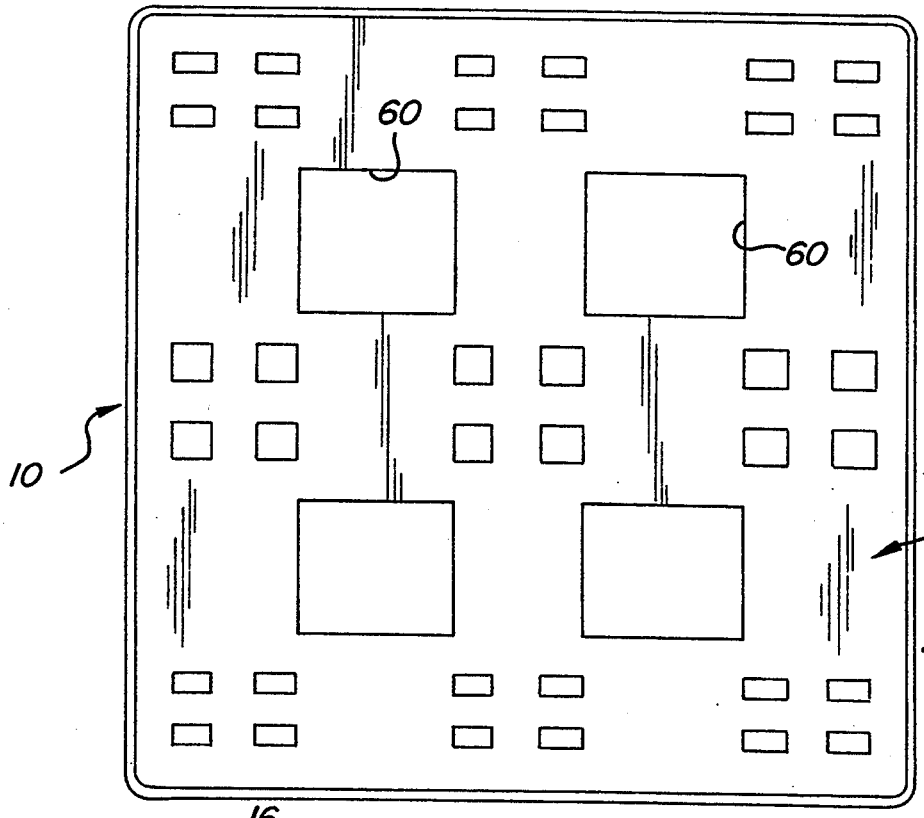
FIG-9
FIG-10
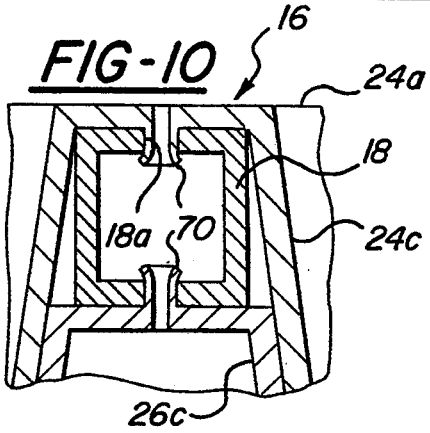
FIG-11
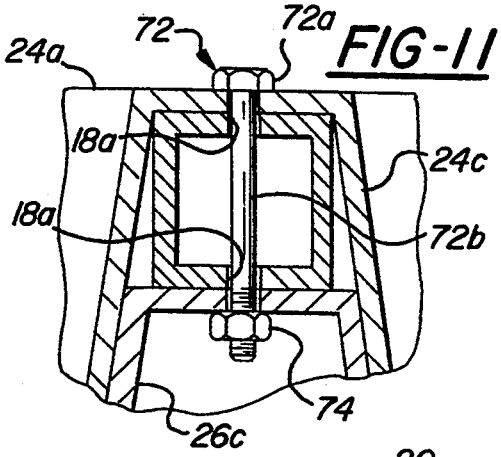
FIG-12
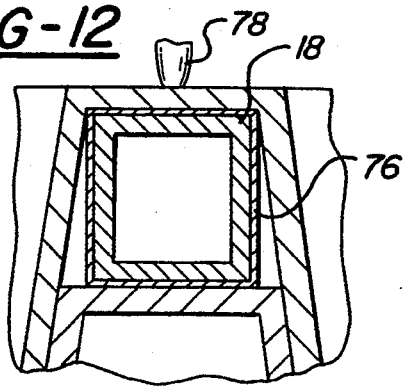
FIG-16
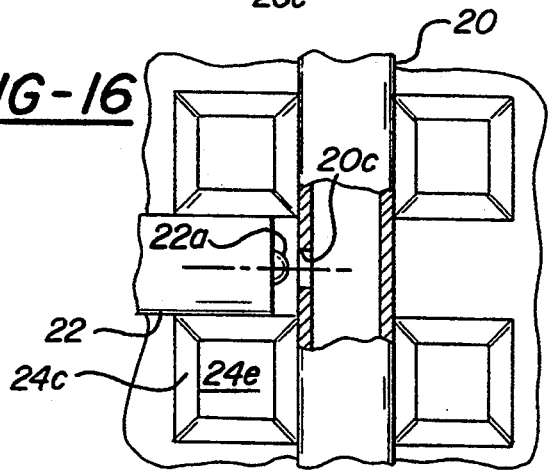

RACKABLE PLASTIC PALLET

RELATED APPLICATION

This application is a continuation-in-part of U.S. patent application Ser. No. 524,299, filed on May 15, 1990, now abandoned, which is a continuation-in-part of U.S. patent application Ser. No. 484,369, filed on Feb. 26, 1990, now abandoned.

BACKGROUND OF THE INVENTION

This invention relates to shipping and storage pallets and more particularly to pallets having a plastic construction.

Pallets have traditionally been formed of wood. Wood pallet however have many disadvantages. For example, they are subject to breakage and thus are not reusable over an extended period of time. They also take up a considerable amount of valuable floor space in the warehouse when they are not in use. They are also difficult to maintain in a sanitary condition, thus limiting their usability in applications where sanitation is important, such for example as in food handling applications. In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectably fused or knitted together in a suitable press to form a reinforced double wall structure. Whereas these twin sheet plastic pallets are generally satisfactory, when they are stored in a rack in a loaded condition, the plastic material of the pallet may tend to creep over a period of time with the result that the platform structure of the pallet may warp to an extent that the pallet becomes disengaged from the rack support members and the pallet, with its load, falls out of the rack. The pallet warpage also creates problems with respect to automatic retrieval systems which depend for their successful operation on the pallet maintaining an essentially unwarped configuration. Attempts have been made to avoid these warpage problems in plastic pallets by arranging some manner of stiffening insert assembly in association with the plastic main body of the pallet, but these prior art stiffening arrangements have tended to be unduly complicated and unduly expensive.

SUMMARY OF THE INVENTION

This invention is directed to the provision of a plastic pallet which is extremely resistant to creepage or warpage.

More specifically, this invention is directed to the provision of a plastic pallet which may be stored on a rack in a loaded condition over extended periods of time without incurring any significant creep or warpage.

The invention pallet includes an upwardly facing load receiving surface and a downwardly facing pallet support surface and is characterized in that the pallet includes a truss including an upper chord positioned within the pallet generally parallel to the load receiving surface, a lower cord positioned generally beneath and parallel to the upper cord, and struts interconnecting the chords. This arrangement incorporates the superior rigidity characteristics of a truss in the pallet structure.

According to a further feature of the invention, the pallet is formed of plastic, the upper and lower chords respectively comprise upper and lower metallic beams, and the struts are formed of plastic. This specific arrangement allows the incorporation of the superior rigidity characteristics of a truss in a plastic pallet.

According to a further feature of the invention, the pallet includes an upper plastic platform structure defining the load receiving surface and incorporating the upper beam and a lower plastic base structure defining the pallet support surface and incorporating the lower beam, and the struts interconnect the upper and lower plastic structures and coact with the upper and lower sections to define tunnels for the entry of material handling equipment.

According to a further feature of the invention the pallet is rectangular and includes leg structures at the four corners of the pallet; the chords are positioned along one side of the pallet; and the leg structures at the corners at the opposite ends of the one side of the pallet comprise the struts of the truss.

According to a further feature of the invention the pallet includes another truss including upper and lower chords positioned along another side of the pallet opposite the one side interconnected by struts constituted by the leg structures at the corners at the opposite ends of the other side of the pallet.

In the disclosed embodiment of the invention, a plurality of upper metallic beams are positioned within the upper platform structure and extend generally parallel to the load receiving surface; a plurality of lower metallic beams are positioned within the lower base structure and extend generally parallel to the pallet support surface; and plastic struts interconnect each upper beam with a corresponding lower beam to form a plurality of truss structures within the pallet.

The struts interconnecting the upper and lower plastic structures comprise legs extending downwardly from the upper plastic structure connected to legs extending upwardly from the lower plastic structure, and the pallet further includes means rigidly interconnecting the upper metallic beams to the upper plastic structure and the lower metallic beams to the lower plastic structure so that upper and lower beams are rigidly interconnected by the struts to optimize the truss action of the beams in coaction with the struts.

According to a further feature of the invention, the platform structure is a twin sheet structure including first and second plastic sheets coacting to define a hollow area therebetween, the upper beams are positioned in the hollow area defined between the first and second sheets, the base structure comprises a twin sheet structure including third and fourth plastic sheets defining a hollow area therebetween, and the lower beams are positioned in the base structure hollow area. This twin sheet construction facilitates the incorporation of the beams in the upper and lower plastic structures and adds to the structural rigidity of the pallet.

In the disclosed embodiment of the invention, the upper beams are respectively received in passageways defined in the hollow area in the upper plastic structure and the lower beams are respectively received in passageways defined in the hollow area of the lower plastic structure.

The invention further provides an improved plastic pallet including a generally planar polygonal platform structure defining a load receiving surface and a leg structure extending downwardly from each corner of the pallet structure characterized in that the leg structure at each corner comprises a cluster of closely grouped but separate downwardly extending hollow legs defining a plurality of closely grouped but separate openings in the load receiving surface. This arrangement preserves the planar integrity of the load receiving surface and augments the compressive strength of the pallet.

According to a further feature of this aspect of the invention, the pallet further includes a base structure defining a pallet support surface and a leg structure extending upwardly from each corner of the base structure with each leg structure comprising a cluster of closely grouped but separate upwardly extending hollow legs corresponding in number and distribution to the downwardly extending legs at the corresponding corner of the platform structure and defining a plurality of closely grouped but separate openings in the pallet support surface. This arrangement maintains the planar integrity of the pallet support surface and further augments the compressive strength of the pallet.

According to a further feature of the invention, the twin sheet construction of the platform structure includes an upper plastic sheet defining a load receiving surface and a lower plastic sheet spaced below the upper plastic sheet; the upper plastic sheet includes a cluster of downwardly extending upwardly opening leg portions at each corner thereof nested within a corresponding cluster of downwardly extending upwardly opening leg portions in each corner of the lower sheet, and the beam members positioned in the hollow of the platform structure extend between adjacent legs of the leg clusters defined within the platform structure. Similarly, the twin sheet construction of the base structure includes third and fourth plastic sheets, each defining upwardly extending, downwardly opening leg portions nested within each other to form the leg clusters at each corner of the base structure, and the beam members positioned in the hollow of the base structure extend between adjacent legs of the leg clusters defined within the base structure.

BRIEF DESCRIPTION OF THE DRAWINGS

FIG. 1 is a perspective view of a plastic pallet according to the invention;

FIGS. 2 and 3 are cross-sectional views taken on lines 2—2 and 3—3 of FIG. 1, respectively;

FIG. 4 is a partially exploded, perspective view of the invention pallet;

FIG. 6 is a detail view taken within the circle 6 of FIG. 5;

FIG. 7 is a detail view looking in the direction of the arrow 7 in FIG. 6;

FIG. 9 is a bottom view of the invention pallet;

FIGS. 10, 11, 12 and 13 are cross-sectional views taken, respectively, on lines 10—10, 11—11, 12—12 and 13—13 of FIG. 3;

FIG. 15 is a detail view taken within the circle 15 of FIG. 2; and

FIG. 16 is a detail view taken within the circle 16 of FIG. 5.

DETAILED DESCRIPTION OF THE PREFERRED EMBODIMENT

Figure 5:
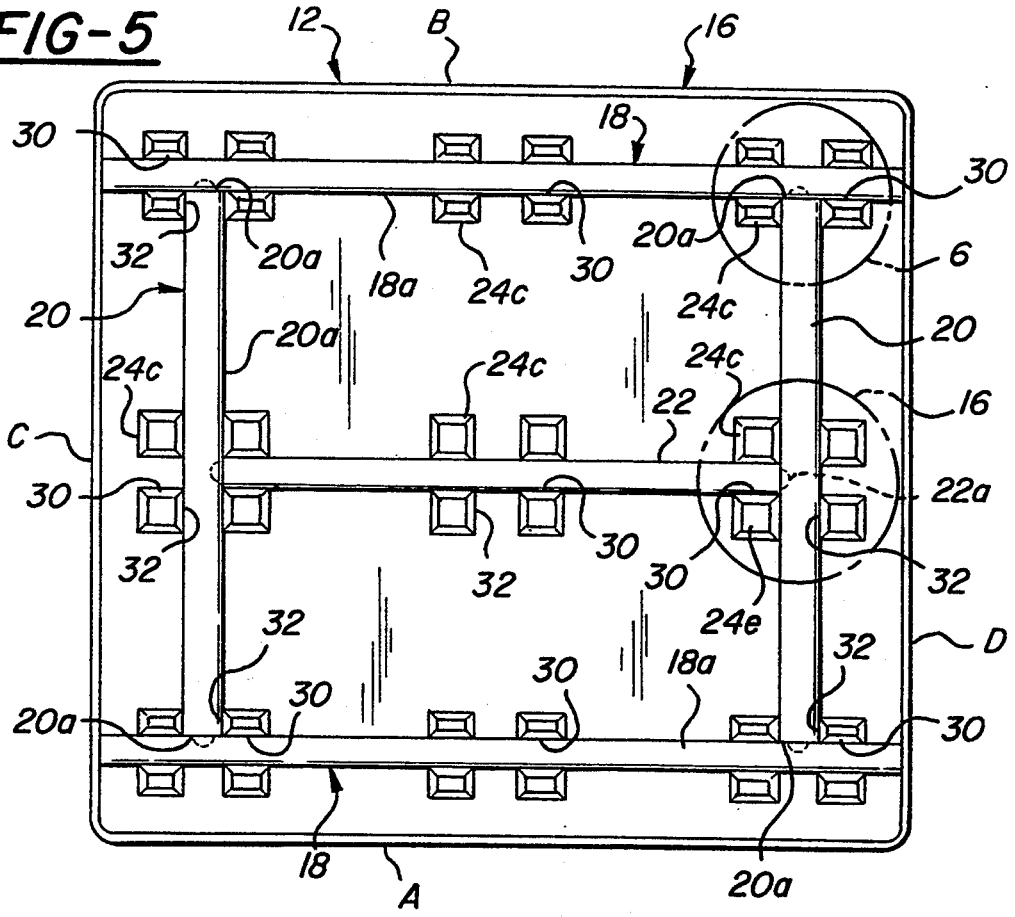
FIG. 5 is a bottom view of the platform structure of the invention pallet with the bottom sheet of the platform structure removed.
Figure 8:
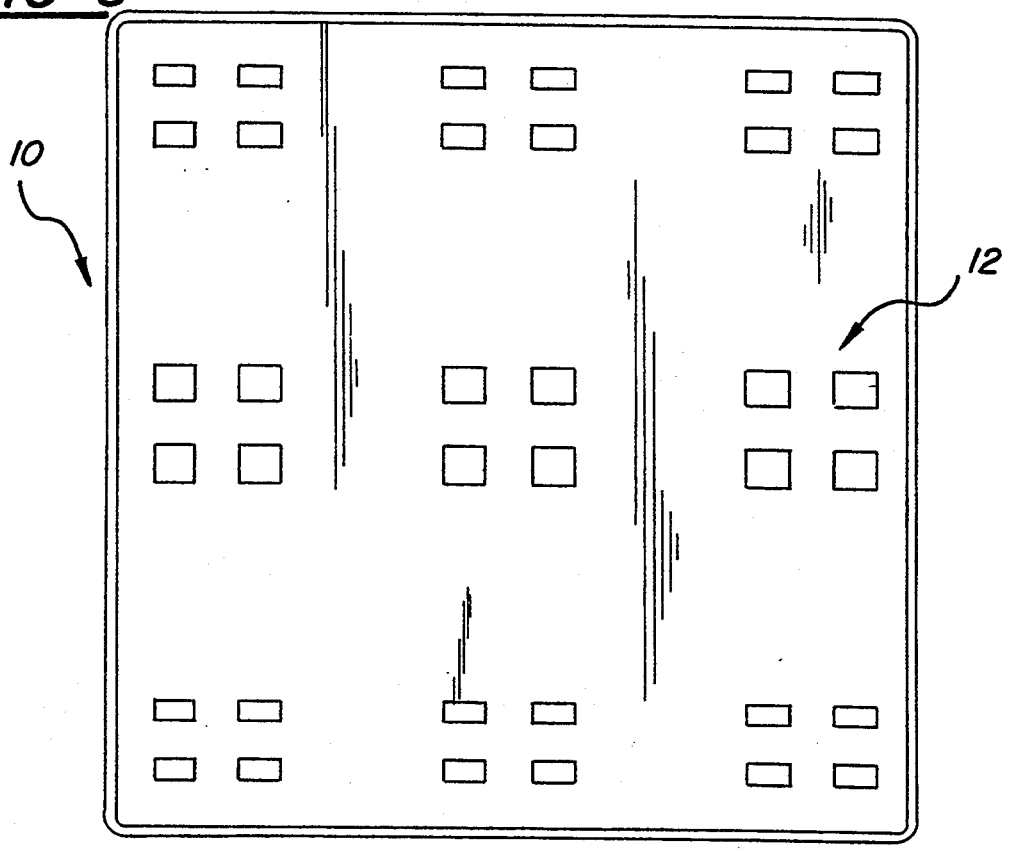
FIG. 8 is a top view of the invention pallet.

The invention pallet 10 may, for example, have a rectangular configuration with relative long sides A and B measuring 48 inches and relatively short sides C and D measuring 40 inches. Pallet 10, broadly considered, includes a generally rectangular platform structure 12 and a generally rectangular base structure 14.

Platform structure 12 includes a rectangular plastic housing 16 and a plurality of beam members 18, 20 and 22.

Plastic housing 16 embodies a twin sheet construction and is formed by vacuum forming an upper rectangular polyethylene plastic sheet 24, vacuum forming a lower polyethylene plastic sheet 26, and thereafter fusing the two sheets together at selected points to form the final rectangular plastic housing structure.

Upper sheet 24 includes a rectangular main body planar portion **24*a* defining an upwardly facing load receiving surface with a downwardly extending flange portion 24*b* extending around the perimeter of the sheet, and a plurality of downwardly extending hollow upwardly opening leg portions 24*c* each opening in the platform surface 24*a* at an opening 24*d***.

Leg portions **24*c* have a rectangular cross section and taper on all four sides downwardly and inwardly to a small rectangular bottom portion 24*e*. Leg portions 24*c*** are arranged in clusters of four with a cluster at each corner of the housing, a cluster along each side edge of the housing midway between adjacent corner clusters, and a central cluster at the center of the housing.

Each cluster of leg portions is arranged in a rectangular pattern with a leg portion at each corner of the rectangular pattern and with the leg portions spaced longitudinally and laterally with respect to the primary axes of the pallet to define longitudinal passageways 30 between the leg portions of a cluster as well as transverse passageways 32 between the leg portions of the cluster.

The leg portions have a cross-sectional configuration such that the openings **24*d* in the load receiving surface 24*a* are very small relative to the total surface area of the load receiving surface so that the openings do not significantly interfere with the integrity of the load receiving surface so that even relatively small objects may be placed on the load receiving surface without fear of the objects falling down into the pockets defined by the hollow leg portions. In the disclosed embodiment, the leg portions 24*c*** forming the intermediate leg structures along short sides D and E of the pallet as well as the leg portions forming the central cluster at the center of the pallet are somewhat larger than the portions forming the remaining leg structures but these respective cross-sectional areas will vary depending upon the particular dimensions and particular structural requirements of the pallet.

For example, for the disclosed 40×48 inch pallet, the larger openings **24*d* along side edges C and D and at the center of the pallet may have dimensions of 3.3 inches by 3.75 inches and the remaining openings 24*d*** may have dimensions of 1.8 inches by 3.75 inches. With these dimensions, each leg opening in the load receiving surface is minuscule relative to the total surface area of the load receiving surface and the leg openings in the load receiving surface, in total, occupy only 4% of the total surface area of the load receiving surface. Accordingly, the leg openings, taken either individually or cumulatively, do not significantly detract from the planar integrity of the load receiving surface.

Lower sheet 26 includes a planar main body portion 26a with an upwardly extending flange portion 26b extending around the perimeter of the sheet, and a plurality of downwardly extending rectangular tapered leg portions 26c opening at 26d in the main body portion 26a. Leg portions 26c are arranged in rectangular clusters and correspond in shape, number, size and pattern to the corresponding leg portions 24c of upper sheet 24 so that a cluster of four leg portions 26c is provided at each corner of the sheet, a cluster of four leg portions is provided at each intermediate location along each side edge of the sheet, and a further cluster of four leg portions is provided at the center of the sheet.

Leg portions 26c have a depth or height significantly less than the depth or height of leg portions 24c and are sized to nestingly receive the lower ends of the leg portions 24c so that, with the leg portions of the upper sheet nested in the corresponding leg portions of the lower sheet, a hollow or space 34 is defined between the upper and lower sheets with the upper sections of leg portions 24c traversing the space and defining the passageways 30 and 32 therebetween. It will thus be seen that hollow 34 also includes the passageways 30 and 32 defined between the upper sections of leg portions 24c so that passageways 30 and 32 have the effect of defining passageways within the hollow 34 extending transversely and longitudinally of the pallet. As will further be seen in FIG. 15, passageways 30, 32 are closed at their lower sides by sections 26a' of main body portion 26a of sheet 26 defined between the leg portions 26c of the appropriate leg cluster.

Beams 18, 20 and 22 comprise, for example, rolled steel tubular members having a generally rectangular cross-sectional configuration but may, depending upon the application, have other and different cross-sectional configurations such as a U-shaped configuration or a hat-shaped configuration.

As best seen in FIG. 5, with upper and lower sheets 24 and 26 fused together to form the plastic housing 16 of the platform structure, beams 18, 20 and 22 are received within the hollow 34 and specifically, beams 18 extend longitudinally within hollow 34 proximate side edges A and B and pass between spaced leg portions of successive leg clusters so as to lie within and along the passageways 30 defined by successive leg clusters. Similarly, beams 20 extend transversely within hollow 34 proximate side edges C and D and lie with and along passageways 32 defined by successive leg clusters with the ends 20a of the beams 20 abutting the side faces 18a of the beams 18. Similarly, beam 22 extends longitudinally and centrally of the pallet within hollow 34 and within and along the passageways 30 defined by the central leg cluster and by the intermediate leg clusters along the side edges C and D with the ends 22a of the beam abutting the side faces 20a of beams 20. The beams 18, 20 and 22 preferably fit snugly between the legs of the various leg clusters and abut tightly against each other so as to form a tight matrix of beams within the hollow 34.

Platform structure 12 is formed by vacuum forming lower sheet 26; placing beams 18, 20 and 22 between the leg portions of the leg clusters in the manner best seen in FIG. 5; vacuum forming upper sheet 24; placing upper sheet 24 over lower sheet 26 with the leg portions in nesting relation with respect to the leg portions of the lower sheet and with flange portion 24b contiguous to flange portion 26b; and fusing sheets 24 and 26 together at the interfaces of the leg portions and the flange portions to form the platform structure.

Base structure 14 is generally similar to platform structure 12 but is employed in an inverted configuration relative to the platform structure to form the final pallet assembly. Specifically, base structure 14 includes a rectangular plastic housing 42 and a plurality of beams 18, 20 and 22; housing 42 is formed by a vacuum formed upper sheet 44 and a vacuum formed lower sheet 46; upper sheet 44 includes a main body portion 44a, a flange portion 44b, and a plurality of upwardly extending downwardly opening hollow leg portions 44c arranged in clusters corresponding in number, size and pattern to the leg clusters formed by the upper plastic housing 16 and tapering upwardly and inwardly to a small rectangular top portion 44d corresponding in size and shape to the bottom portions 26e of leg portions 26c; lower sheet 46 includes a main body portion 46a defining a pallet support surface for the pallet, a flange portion 46b, and a plurality of upwardly extending, downwardly opening leg portions 46c opening in pallet support surface 46a at relatively small openings 46d and conforming in size and distribution to the leg portions 44c of upper sheet 44; leg portions 46c are received in nesting fashion in the respective leg portions 44c and have a height greater than the height of leg portions 44c so as to define a hollow 50 between the sheets when the sheets are fused together at the interfaces of the nested leg portions and peripheral flanges 44b, 46b with the lower sections of leg portions 46c traversing the space and defining the passageways 30, 32 therebetween; beams 18 are positioned within hollow 50 and specifically extend longitudinally proximate side edges A and B and lie along and within the passageways 30 defined between adjacent leg portions of the leg clusters; beams 20 are positioned within hollow 50 and specifically extend transversely proximate side edges C and D and lie within and along passageways 32 defined between adjacent leg portions of the leg clusters; beam 22 is positioned within hollow 50 and specifically extends longitudinally and centrally along and within the passages 30 defined between the individual leg portions of the leg clusters defined along the central portion of the pallet; and the passageways 30 and 32 are closed at their upper sides by sections 44a' of main body portion 44a of sheet 44 defined between the leg portions 44c of the appropriate leg cluster.

Base structure 14 is formed by vacuum forming lower sheet 46; placing beams 18, 20 and 22 between the leg portions of the leg clusters in the manner demonstrated in FIG. 5; vacuum forming upper sheet 44; placing upper sheet 44 over lower sheet 46 with the leg portions in nesting relation with respect to the leg portions of the lower sheet and with flange portion 44b contiguous to flange portion 46b; and fusing sheets 44 and 46 together at the interfaces of the leg portions and the flange portions to form the base structure. Following the formation of the base structure, rectangular openings 60 are formed in the lower sheet 46 between adjacent beams.

Following the formation of the platform structure and the base structure, the base structure and the platform structure are fused together at the interfaces defined by the top portions 44d of the upwardly extending leg portions of the base structure and the bottom portions 26e of the downwardly extending leg portions of the platform structure to form the final pallet assembly. The fused together leg portions of the platform structure and the base structure will be seen to define tunnels or passageways 62 between the platform structure and base structure to allow the entry of the forks of a forklift truck from any of the four sides of the pallet or to position the wheels of a lowboy in the openings 60 to provide a reaction surface to allow the pallet to be raised above the support surface in response to jacking movement of the handle of the lowboy in known manner.

As best seen in FIG. 3, the downwardly extending leg portions 26*c* of the platform structure coact with the upwardly extending leg portions 44*c* of the base structure to define struts 66 of generally hourglass configuration extending between the base structure and the platform structure and the struts in turn coact with the beams in the upper and lower structure to form trusses within the pallet with the beams comprising the chords of the truss and the fused together leg portions comprising the struts interconnecting the chords of the truss. Specifically, the leg portions and beams coact to define a first truss extending along the side edge A of the pallet; a second truss extending along the side edge B of the pallet; a third truss extending along the side edge C of the pallet; a fourth truss extending along the side edge D of the pallet; and a fifth truss extending centrally of the pallet between side edge C and side edge D.

The first truss includes the beam 18 in the platform structure positioned along side edge A, the corresponding beam 18 in the base structure positioned along side edge A, and the struts formed by the leg structures along side edge A.

The second truss includes the beam 18 in the platform structure positioned along side edge B, the corresponding beam 18 in the base structure positioned along side edge B, and the struts formed by the leg structures along the side edge B.

The third truss includes the beam 20 in the platform structure positioned along side edge C, the corresponding beam 20 in the base structure positioned along side edge C, and the struts formed by the leg structures along side edge C.

The fourth truss includes the beam 20 in the platform structure positioned along side edge D, the corresponding beam 20 in the base structure positioned along side edge D, and the struts formed by the leg structures along side edge D.

The fifth truss includes the beam 22 in the platform structure, the beam 22 in the base structure, and the struts formed by the leg structures in the central region of the pallet.

In order to optimize the effectiveness of the truss in each case, it is important that the beams be rigidly secured to the associated plastic housing structure so that the beams and plastic housing structure act as a unit to optimize the truss action and firmly couple the upper beam of each truss to the lower beam of each truss so that the beams in each truss must of necessity move in unison whereby to optimize the stiffness of the truss. Various means of rigidly securing the beams to the plastic housing structures are shown in FIGS. 10, 11, 12 and 13 and it will be understood that normally only one such method would be employed in a given pallet.

In the securing arrangement of FIG. 10, the beams are provided with upper and lower holes (for example, 18*a* in each beam 18) at spaced locations along the beam and plastic material from the surrounding plastic structure is heat staked into the holes 18*a* to form a plastic rivet 70 at spaced locations along the upper and lower faces of the beam.

In the arrangement seen in FIG. 11, nut and bolt fasteners 72, 74 are utilized to secure the beams to the associated plastic structure with the heads 72*a* of the bolts positioned against the load receiving surface 24*a* and the shafts 72*b* of the bolts passing downwardly through openings 18*a* in the beam and through aligned openings in the associated plastic housing structure for threaded engagement with the nuts 74 to firmly and rigidly secure the beam to the associated plastic housing structure.

In the arrangement seen in FIG. 12, the beam 18 is first provided with a suitable plastic coating 76 and, following mounting of the beam within the associated plastic structure in the manner previously described, the coating 76 is fused to the associated plastic of the housing by the use of sonic welding employing, for example, a sonic horn 78.

Figure 13:
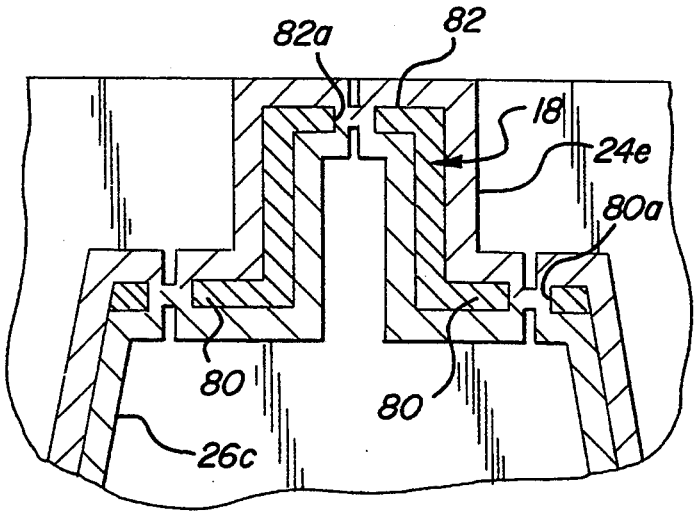
Figure 14:
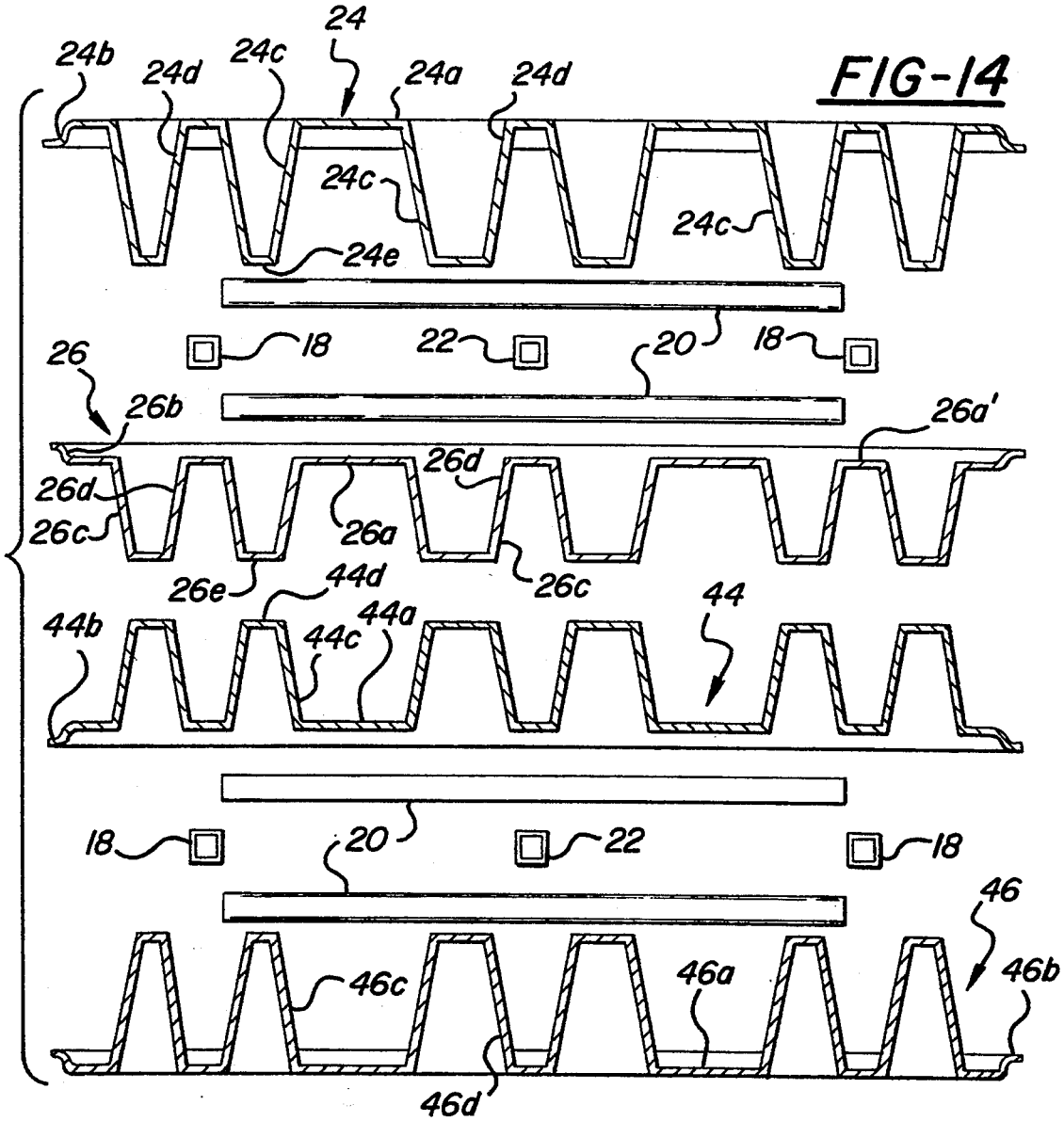
FIG. 14 is a totally exploded elevational view of the invention pallet.

In the arrangement seen in FIG. 13, the beam 18 employs a hat cross-sectional configuration including flange portions 80 and an upstanding central channel portion 82, the twin sheet construction of the associated plastic structure is provided with a hat cross-sectional configuration such that the entire beam cross section is sandwiched between hat portions of the upper and lower sheets 24, 26 of the platform structure, and heat staking is employed to flow plastic into suitable openings 80*a* provided at longitudinally spaced locations along the flanges 80 and into suitable openings 82*a* provided at longitudinally spaced locations along the channel portion 82 whereby to firmly lock the beam to the associated plastic structure.

Whereas the rigid securement of the beam to the associated plastic structure has been described in each case with reference to a beam 18, it will be understood that in each case the other beams 20, 22 would be similarly rigidly secured to the associated plastic structure.

Regardless of the method employed to rigidly secure the beams to the associated plastic structure, rigid securement has the effect of creating a unitary rigid structure as between the upper and lower beams or chords and the plastic structure interconnecting the upper and lower beams so as to optimize the truss effect.

Rather than positively locking the beams to the associated plastic structure, or possibly as a supplement to a positive locking arrangement, the beams may be interlocked relative to each other and relative to the legs (and thereby relative to the plastic structure) by utilizing the shrinkage that occurs within the plastic structure as the plastic cools down from its fusion temperature. Thus, as seen in FIGS. 6 and 7, following the fusing together of the upper and lower sheets 24, 26 of the platform structure with the beams 18, 20, 22 positioned therewithin in the manner previously described, the plastic material of the plastic structure shrinks both longitudinally and transversely as it cools and this shrinkage is employed to move hemispherical buttons 20*b* on the ends 20*a* of beams 20 into locking coaction with holes 18b in the associated beam 18. Specifically, beams 20 are sized such that they are spaced at their ends from the confronting surfaces of beams 18 with the plastic in an expanded, heated configuration but, as the plastic cools, the leg portions of the plastic structure move the ends of the beams 20 relative to beams 18 along the composite, vectorial line 90 to thereby move buttons 20*b* into snapping coaction with holes 18*a* with the movement of the buttons along the composite line 90 being facilitated by flexing movement of a tab portion 18*c* provided proximate each hole 18b by slit lines 18*d*. It will be understood that tab portion 18*c* flexes to allow movement of button 20*b* along line 90 and thereafter snaps back to a locking disposition with respect to the button as the button moves into the hole 18*b*. Arrangements such as seen in FIGS. 6 and 7 are provided at all four locations in the platform structure and in the base structure where an end 20*a* of a beam 20 confronts a beam 18 and, additionally, as seen in FIG. 16, center beam 22 in both the platform structure and in the base structure is provided with end buttons 22*a* which move into locking engagement with holes 20*c* in confronting beams 20 as the plastic material shrinks with the movement of the button, in this case, being parallel to the axis of the beam 22 by virtue of the central disposition of beam 22 relative to the plastic material of the associated pallet structure.

The invention pallet will be seen to retain all of the advantages of a plastic pallet while overcoming the disadvantages of prior art plastic pallets. Specifically, the invention pallet is especially effective in situations where the pallet is loaded and placed in a loaded condition on a storage rack with the pallet supported by the ends of the base structure. When thus racked, the trusses within the pallet act to preclude creepage or warpage of the pallet even over extended periods of storage, thus avoiding the problems with prior art plastic pallets which, when utilized in a loaded, racked situation, have tended to creep and warp over a period of time with the result that the pallets have become disengaged from the mounting brackets in the rack and the pallets with their loads have fallen out of the rack. The invention pallet, by avoiding pallet warpage, also overcomes the problem with prior art pallets wherein the pallets after extended periods of use assume a warpage that complicates their handling by standardized automatic retrieval equipment.

Further, the use of leg clusters to interconnect the upper and lower structures of the pallet provides a rigid pallet structure without sacrificing the integrity of the planar load receiving surface of the pallet or the integrity of the planar support surface of the pallet.

The invention pallet also facilitates handling either by the forks of a forklift truck or by lowboys. Specifically, the forks of a forklift may enter the pallet from any of the four sides of the pallet with the forks entering into the tunnels formed both crosswise and lengthwise between the legs. The pallet also provides access from all four sides of the pallet by a lowboy entering the tunnels to position the wheels of the lowboy in the opening 60 to access the surface supporting the pallet and provide a reaction surface to allow the pallet to be raised above the support surface in response to jacking movement of the handle of the lowboy.

Whereas a preferred embodiment of the invention has been illustrated and described in detail it will be apparent that various changes may be made in the disclosed embodiment without departing from the scope or spirit of the invention.

I claim:

1. A pallet comprising:

an upper generally planar platform structure including an upper plastic housing defining an upper load receiving surface, upper elongated metallic beams positioned within said upper plastic housing with their longitudinally extending surfaces extending generally parallel to said load receiving surface, and locking means engaging the longitudinally extending surfaces of the upper metallic beams and operative to rigidly secure said longitudinal surfaces of said upper metallic beams to said upper plastic housing;

a lower generally planar base structure including a lower plastic housing defining a lower pallet support surface, lower metallic beams positioned within the lower plastic housing and extending generally parallel to said pallet support surface, and means rigidly securing said lower metallic beams to said lower plastic housing; and means rigidly interconnecting said upper and lower plastic housings.

2. A pallet according to claim 1 wherein the interconnected housings define plastic struts extending between said platform structure and said base structure and coacting with said structures to define tunnels therebetween for the entry of material handling equipment.

3. A pallet according to claim 2 wherein said struts are defined by legs extending downwardly from said upper housing connected to legs extending upwardly from said lower housing.

4. A pallet according to claim 2 wherein at least one of said upper beams is positioned in generally vertical alignment with one of said lower beams and plastic struts are positioned in general vertical alignment with said one upper beam and said one lower beam so as to form a truss within the pallet having upper and lower chords defined by said aligned upper and lower beams.

5. A pallet comprising:

an upper generally planar platform structure including an upper plastic housing defining an upper load receiving surface, upper metallic beams positioned within said upper plastic housing and extending generally parallel to said load receiving surface, and means rigidly securing said upper metallic beams to said upper plastic housing to preclude movement of the beam relative to the upper plastic housing;

a lower generally planar base structure including a lower plastic housing defining a lower pallet support surface, lower metallic beams positioned within the lower plastic housing and extending generally parallel to said pallet support surface, and means rigidly securing said lower metallic beams to said lower plastic housing;

means rigidly interconnecting said upper and lower plastic housings;

the interconnected housings defining plastic struts extending between said platform structure and said base structure and coacting with said structures to define tunnels therebetween for the entry of material handling equipment;

said struts being defined by legs extending downwardly from said upper housing connected to legs extending upwardly from said lower housing;

said platform structure comprising a twin sheet structure including first and second plastic sheets coacting to define a hollow area therebetween, said upper beams being positioned in said platform structure hollow area, said base structure comprising a twin sheet structure including third and fourth plastic sheets defining a hollow area therebetween;

said lower beams being positioned in said base structure hollow area.

6. A pallet according to claim 5 wherein said first sheet defines said load receiving surface, said second sheet defines said upper housing legs, said third sheet defines said lower housing legs, and said fourth sheet defines said pallet support surface.

7. A pallet according to claim 5 wherein said first and second sheets coact to define upper passageways within said platform structure hollow area, said upper beams are received respectively in said upper passageways, said third and fourth sheets coact to define lower passageways within said base structure hollow area, and said lower beams are received respectively in said lower passageways.

8. A pallet comprising:

a plastic upper structure including a planar platform section defining an upwardly facing load receiving surface and a plurality of legs extending downwardly from said platform section to define tunnels therebetween for receipt of the forks of a forklift truck;

a plastic lower structure extending beneath said plastic upper structure, fused to the bottoms of said legs, and defining a passageway within said plastic lower structure;

a rigid elongated beam member positioned within said passageway with its longitudinal surfaces extending parallel to said load receiving surface; and locking means engaging the longitudinally extending surfaces of the beam and operative to rigidly secure said longitudinally extending surfaces of said beam member to said plastic lower structure.

9. A pallet according to claim 8 wherein a plurality of passageways are defined within said lower structure, a beam member is received in each passageway, and each beam member is rigidly secured to the plastic lower structure.

10. A pallet comprising:

a plastic upper structure defining a planar platform section defining an upwardly facing load receiving surface and a plurality of legs arrayed in rows extending downwardly from said platform section with the bottoms of said rows defining downwardly facing attachment surface means;

a plastic base structure positioned beneath said upper structure and including upwardly facing attachment surface means confronting said downwardly facing attachment surface means and a flat lower surface spaced below said upwardly facing attachment surface means and adapted to support the pallet on a support surface, said base structure defining a hollow therewithin and being fused to said plastic upper structure at the confronting interface of said attachment surface means to form a unitary plastic pallet with the fused structures coacting to define tunnels therebetween for the entry of material handing equipment;

a beam member positioned in said hollow and extending generally parallel to said load receiving surface; and aperture means comprising openings extending through said base structure to allow elements of material handling equipment positioned in said tunnels to access the support surface to facilitate lifting of the pallet.

11. A pallet comprising:

a main body plastic structure defining a planar platform section defining an upwardly facing load receiving surface defined by a first upper plastic sheet and downwardly facing attachment surface means defined by a second lower plastic sheet;

a base plastic structure positioned beneath said platform section, secured to said attachment surface means of said main body plastic structure, and having a configuration generally corresponding to the configuration of said main body plastic structure; and a plurality of metallic elongated tubular beam members incorporated in said base plastic structure with their longitudinal surfaces extending parallel to said load receiving surface; and locking means engaging the longitudinally extending surfaces of the beam and operative to rigidly secure said longitudinally extending surface of said beam member to said base plastic structure.

12. A pallet including an upper plastic structure including a main body portion defining an upwardly facing load receiving surface and a lower plastic structure including a main body portion defining a downwardly facing pallet support surface, characterized in that the pallet includes an elongated upper beam positioned within the main body portion of the upper plastic structure and extending generally parallel to said load receiving surface, means fixedly securing the longitudinal surfaces of said upper beam to said main body portion of said upper plastic structure, an elongated lower beam positioned within the main body portion of the lower plastic structure and extending generally parallel to said upper beam, and means fixedly securing the longitudinal surfaces of said lower beam to said main body portion of said lower plastic structure, and the upper and lower plastic structures define struts rigidly interconnecting said main body portions and coacting with said beams to form a truss.

13. A pallet according to claim 12 wherein said struts coact with the main body portions of the upper and lower structures to define tunnels for the entry of material handling equipment.

14. A pallet according to claim 12 wherein:

said pallet is rectangular and includes leg structures at the four corners of the pallet;

said beams are positioned along one side of the pallet; and the leg structures at the corners at the opposite ends of said one side of the pallet comprise the struts of said truss.

15. A pallet according to claims 14 wherein said pallet includes another truss including upper and lower beams positioned along another side of said pallet opposite said one side interconnected by struts constituted by the leg structures at the corners at the opposite ends of said other side.

16. A pallet comprising an upper plastic platform structure and a lower base structure positioned beneath and secured to said upper plastic structure to form the pallet and coacting with the platform structure to define a plurality of tunnels for the entry of material handling equipment, characterized in that:

the base structure comprises a lower base plastic sheet having a planar main body portion and upwardly extending hollow leg portions, and an upper base plastic sheet having a planar main body portion and upwardly extending hollow leg portions nestingly receiving the respective hollow leg portions of the lower base sheet and fused at their interface with the lower base sheet leg portions to form the base structure;

the platform structure comprises an upper platform plastic sheet having a planar main body portion and downwardly extending hollow leg portions and a lower platform plastic sheet having a planar main body portion and downwardly extending hollow leg portions nestingly receiving the respective downwardly extending hollow leg portions of the upper platform plastic sheet and fused at their interface with the lower platform sheet leg portions to form the platform structure;

the upper faces of the leg portions of the upper base plastic sheet are fused to the lower faces of the leg portions of the lower platform plastic sheet to form the pallet;

the leg portions of said lower base sheet have a height greater than the height of the leg portions of said upper base sheet so that, with the leg portions of the lower base sheet nested in the leg portions of the upper base sheet, a space is defined between the main body portions of the upper and lower base sheet; and a plurality of beam members are positioned in said space.

17. A pallet according to claim 16 wherein said upper and lower base sheets when fused together coact to define a plurality of passageways within said space and said beams are respectively positioned in said passageways.

18. A method of forming a plastic pallet comprising:

forming first and second plastic sheets each having a main body generally planar portion and downwardly extending hollow leg portions;

nesting the hollow leg portions of said first sheet in the hollow leg portions of said second sheet and fusing said first and second sheets together at the leg portion interfaces to form a twin sheet upper plastic structure having a planar platform section defined by the main body portions of said first and second sheets and legs extending downwardly from the platform section;

forming third and fourth plastic sheets each having a main body planar portion and upwardly extending hollow leg portions;

nesting the hollow leg portions of said fourth sheet in the hollow leg portions of said third sheet and fusing said third and fourth sheets together at the leg portion interfaces to form a twin sheet lower plastic structure having a planar base section defined by the main body portions of said third and fourth sheets and legs extending upwardly from the base section; and fusing the lower ends of the downwardly extending legs of the upper structure to the upper ends of the upwardly extending legs of the lower structure to form the pallet.

19. The method of claim 18 and including the further steps of:

forming the downwardly extending leg portions of said first sheet with a greater height than the downwardly extending leg portions of said second sheet so that a hollow area is defined between the main body portions of said first and second sheets when the leg portions of said first sheet are nested in the leg portions of said second sheet; and positioning a plurality of beam members in said hollow area.

20. A method according to claim 18 and including the further steps of:

forming the upwardly extending leg portions of said fourth sheet with a greater height than the upwardly extending leg portions of said third sheet so that a hollow area is defined between the main body portions of said third and fourth sheets when the leg portions of said fourth sheet are nested in the leg portions of said third sheet; and positioning a plurality of beam members in said hollow area.

21. A method according to claim 18 wherein the method includes the further steps of:

forming the downwardly extending leg portions of said first sheet with a greater height than the downwardly extending leg portions of said second sheet so that a first hollow area is defined between the main body portions of said first and second sheets when the leg portions of said first sheet are nested in the leg portions of said second sheet;

positioning a plurality of upper beam members in said first hollow area;

forming the upwardly extending leg portions of said fourth sheet with a greater height than the upwardly extending leg portions of said third sheet so that a second hollow area is defined between the main body portions of said third and fourth sheets when the leg portions of said fourth sheet are nested in the leg portions of said third sheet; and positioning a plurality of lower beam members in said second hollow area.

22. A method according to claim 18 wherein said first and second sheets are configured to define a plurality of passageways therebetween and wherein a plurality of beam members are respectively positioned in said passageways.

23. A method according to claim 22 wherein the downwardly extending hollow leg portions of said first and second sheets are formed in clusters, the leg portions of the first sheet are formed with a greater height than the leg portions of the second sheet so that a space is defined between the main body portions of the first and second sheets when the leg portions of the first sheet are nested in the leg portions of the second sheet with the upper sections of the leg portions of the first sheet traversing the space, and the passageways extend between the upper sections of adjacent first sheet leg portions of a respective leg portion cluster.

24. A method according to claim 18 wherein said third and fourth sheets are configured to define a plurality of passageways therebetween and a plurality of beam members are respectively positioned in said passageways.

25. A method according to claim 24 wherein the upwardly extending hollow leg portions of said third and fourth sheets are formed in clusters, the leg portions of the fourth sheet are formed with a greater height than the leg portions of the third sheet so that a space is defined between the main body portions of said third and fourth sheets when the leg portions of the fourth sheet are nested in the leg portions of the third sheet with the lower sections of the leg portions of the fourth sheet traversing the space, and the passageways extend between the lower sections of adjacent fourth sheet leg portions of a respective leg portion cluster.

26. A method according to claim 18 wherein the sheets are rectangular and the hollow leg portions of each sheet are formed in clusters with a cluster proximate each corner of the sheet.

27. A plastic pallet including a generally planar polygonal platform structure defining a load receiving surface and a plurality of leg structures extending downwardly from each corner of the platform structure, characterized in that the leg structures at each corner comprising a cluster of closely grouped but separate downwardly extending hollow legs defining a cluster of closely grouped but separate openings in said load receiving surface, said pallet further includes a generally planar polygonal base structure defining a pallet support surface and a plurality of leg structures extending upwardly from each corner of the base structure with each leg structure comprising a cluster of closely grouped but separate upwardly extending hollow legs corresponding in number and distribution to the downwardly extending legs at the corresponding corner of said platform structure and defining a plurality of closely grouped but separate openings in said pallet support surface, a plurality of passageways are defined within said platform structure extending parallel to said load receiving surface, a plurality of rigid beams are respectively received in said passageways, a plurality of lower passageways are defined in said base structure extending generally parallel to the load receiving surface, a plurality of rigid beams are respectively received in said base structure passageways, and each of said passageways extends between adjacent legs of said leg clusters.

28. A twin sheet generally rectangular pallet comprising a lower sheet having a planar main body portion and downwardly extending hollow lower leg portions and an upper sheet having a planar main body portion and downwardly extending hollow upper leg portions nested in the lower leg portions of the lower sheet and having a height greater than the height of the lower leg portions so as to define a space between the planar main body portions of the sheets with the upper sections of the upper leg portions traversing the space, characterized in that each sheet includes a cluster of closely spaced leg portions proximate each corner of the sheet which coact when respectively nested within each other to define a cluster of leg portions proximate each corner of the pallet, and the pallet further includes a plurality of beams positioned in said space with the opposite ends of each beam received between the upper sections of adjacent upper leg portions in a respective leg portion cluster.

29. A pallet comprising an upper plastic platform structure and a lower base structure positioned beneath and secured to said upper plastic structure to form the pallet and coacting with the platform structure to define a plurality of tunnels for the entry of material handling equipment, characterized in that:

the base structure comprises a lower plastic sheet having a planar main body portion and upwardly extending hollow leg portions and an upper sheet having a planar main body portion and upwardly extending hollow leg portions nestingly receiving the respective hollow leg portions of the lower sheet, fused at their interface with the lower sheet leg portions to form the base structure, and having upper faces fused to said upper plastic platform structure to form the pallet;

the leg portions of said lower sheet have a height greater than the height of the leg portions of said upper sheet so that, with the leg portions of the lower sheet nested in the leg portions of the upper sheet, a space is defined between the main body portions of the upper and lower sheets;

a plurality of beam members are positioned in said space;

said upper and lower sheets, when fused together coact to define a plurality of passageways within said space;

said beams are respectively positioned in said passageways;

each sheet includes a cluster of closely spaced leg portions proximate each corner of the sheet with the leg portions of the respective leg portion cluster on the upper sheet nestingly receiving a cluster of leg portions on the lower sheet so that the lower sections of the leg portions of the leg portion clusters of the lower sheet traverse the space between the main body portions of the upper and lower sheets; and the passageways in which said beams are positioned extend between the lower sections of adjacent lower sheet leg portions of a respective leg portion cluster.

30. A plastic pallet including a generally planar polygonal platform structure defining a load receiving surface and a plurality of leg structures extending downwardly from each corner of the platform structure, characterized in that the leg structures at each corner comprise a cluster of closely grouped but separate downwardly extending hollow legs defining a cluster of closely grouped but separate openings in said load receiving surface and said pallet further includes a generally planar polygonal base structure defining a pallet support surface and a plurality of leg structures extending upwardly from each corner of the base structure with each leg structure comprising a cluster of closely grouped but separate upwardly extending hollow legs corresponding in number and distribution to the downwardly extending legs at the corresponding corner of said platform structure, respectively fused at their upper ends to the lower ends of the downwardly extending legs, and defining a plurality of closely grouped but separate openings in said pallet support surface, said platform structure being a twin sheet structure including an upper sheet defining said load receiving surface and a lower sheet positioned beneath said upper sheet with said upper and lower sheets each defining a cluster of closely grouped but separately downwardly extending upwardly opening hollow legs proximate each corner thereof with the legs of the upper sheet nested within the legs of the lower sheet to form the downwardly extending legs.

31. A plastic pallet including a generally planar polygonal platform structure defining a load receiving surface and a plurality of leg structures extending downwardly from each corner of the platform structure, characterized in that the leg structures at each corner comprise a cluster of closely grouped but separate downwardly extending hollow legs defining a cluster of closely grouped but separate openings in said load receiving surface, and said pallet further includes a generally planar polygonal base structure defining a pallet support surface and a plurality of leg structures extending upwardly from each corner of the base structure with each leg structure comprising a cluster of closely grouped but separate upwardly extending hollow legs corresponding in number and distribution to the downwardly extending legs at the corresponding corner of said platform structure, respectively fused at their upper ends to the lower ends of the downwardly extending legs, and defining a plurality of closely grouped but separate openings in said pallet support surface, said platform structure being a twin sheet structure including a first sheet defining said load receiving surface and a second sheet positioned below said first sheet, said first and second sheets each including a cluster of closely grouped but separately downwardly extending upwardly opening legs proximate each corner thereof, the legs of said first sheet being respectively nested in the legs of said second sheet to define said downwardly extending hollow legs, said base structure comprising a twin sheet structure including a third sheet and a fourth sheet, said fourth sheet defining said pallet support surface, each of said third and fourth sheets including a cluster of closely grouped but separate upwardly extending downwardly opening hollow legs proximate each corner thereof, and the legs of the fourth being nested respectively in the legs of the third sheet to form said upwardly extending legs.

32. A plastic pallet including a generally planar polygonal platform structure defining a load receiving surface and a plurality of leg structures extending downwardly from each corner of the platform structure, characterized in that the leg structures at each corner comprise a cluster of closely grouped but separate downwardly extending hollow legs defining a cluster of closely grouped but separate openings in said load receiving surface, and said pallet further includes a generally planar polygonal base structure defining a pallet support surface and a plurality of leg structures extending upwardly from each corner of the base structure with each leg structure comprising a cluster of closely grouped but separate upwardly extending hollow legs corresponding in number and distribution to the downwardly extending legs at the corresponding corner of said platform structure, respectively fused at their upper ends to the lower ends of the downwardly extending legs, and defining a plurality of closely grouped but separate openings in said pallet support surface, said platform structure defining passageways therewithin extending parallel to said load receiving surface and the pallet further including rigid beams received respectively in said passageways.

33. A plastic pallet including a generally planar polygonal platform structure defining a load receiving surface and a plurality of leg structures extending downwardly from each corner of the platform structure, characterized in that the leg structures at each corner comprise a cluster of closely grouped but separate downwardly extending hollow legs defining a cluster of closely grouped but separate openings in said load receiving surface, and said pallet further includes a generally planar polygonal base structure defining a pallet support surface and a plurality of leg structures extending upwardly from each corner of the base structure with each leg structure comprising a cluster of closely grouped but separate upwardly extending hollow legs corresponding in number and distribution to the downwardly extending legs at the corresponding corner of said platform structure, respectively fused at their upper ends to the lower ends of the downwardly extending legs, and defining a plurality of closely grouped but separate openings in said pallet support surface, a plurality of passageways being defined within said platform structure extending parallel to said load receiving surface, a plurality of rigid beams being respectively received in said passageways, a plurality of lower passageways being defined in said base structure extending generally parallel to the load receiving surface, and a plurality of rigid beams being respectively received in said base structure passageways.

* * * * *